US010594115B2

(12) United States Patent
Tanaka et al.

(10) Patent No.: US 10,594,115 B2
(45) Date of Patent: Mar. 17, 2020

(54) SPARK PLUG OF INTERNAL COMBUSTION ENGINE

(71) Applicant: DENSO CORPORATION, Kariya, Aichi-pref. (JP)

(72) Inventors: Daisuke Tanaka, Nisshin (JP); Fumiaki Aoki, Nisshin (JP); Daisuke Shimamoto, Kariya (JP); Naoto Hayashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/405,106

(22) Filed: May 7, 2019

(65) Prior Publication Data

US 2019/0348821 A1 Nov. 14, 2019

(30) Foreign Application Priority Data

May 11, 2018 (JP) ..... 2018-092411

(51) Int. Cl.
*H01T 13/32* (2006.01)
*H01T 13/26* (2006.01)
*H01T 13/08* (2006.01)

(52) U.S. Cl.
CPC ..... *H01T 13/32* (2013.01); *H01T 13/08* (2013.01); *H01T 13/26* (2013.01)

(58) Field of Classification Search
None
See application file for complete search history.

(56) References Cited

U.S. PATENT DOCUMENTS

2009/0140624 A1* 6/2009 Kameda ..... H01T 21/02 313/141
2012/0097140 A1* 4/2012 Kusunoki ..... F02P 9/002 123/620
2019/0103731 A1* 4/2019 Tanaka ..... H01T 13/04

FOREIGN PATENT DOCUMENTS

JP 2017-079171 4/2017

* cited by examiner

*Primary Examiner* — Ashok Patel
(74) *Attorney, Agent, or Firm* — Nixon & Vanderhye P.C.

(57) ABSTRACT

In a spark plug, a discharge gap is formed between a ground electrode and a central electrode. The ground electrode has a rod-shaped part and an opposing part. The opposing part faces the central electrode, and has a flat surface part and a slope surface part. The slope surface part is formed on a part of the opposing part in an extending direction of the ground electrode, and formed on the opposing part and gradually separated from the central electrode along a width direction of the opposing part. The spark plug has a ratio V/W within a range of 0.5<V/W<2.0. V indicates a length of the opposing part measured in a gap formation direction in which the central electrode, the discharge gap and the opposing part are arranged in order. W indicates a length of the opposing part in the ground electrode width direction.

9 Claims, 15 Drawing Sheets

SPARK PLUG OF INTERNAL COMBUSTION ENGINE

CROSS-REFERENCE TO RELATED APPLICATION

This application is related to and claims priority from Japanese Patent Application No. 2018-092411 filed on May 11, 2018, the contents of which are hereby incorporated by reference.

TECHNICAL FIELD

The present disclosure relates to spark plugs to be used in internal combustion engines.

BACKGROUND

There have been used spark plugs for igniting a fuel mixture gas in an internal combustion engines mounted on motor vehicles. Such a spark plug has a structure in which a central electrode and a ground electrode are arranged facing with each other along an axial direction of the spark plug. A spark plug is mounted on an engine head of an internal combustion engine so that a front end part of the spark plug faces an inside of a combustion chamber of the internal combustion engine. A spark discharge is generated at a discharge gap between the central electrode and the ground electrode of the spark plug so as to ignite a fuel mixture gas in the combustion chamber. There is room for improvement on a structure of a spark plug so as to improve ignition capability of the spark plug to ignite a fuel mixture gas.

SUMMARY

It is desired for the present disclosure to provide an exemplary embodiment which provides a spark plug having an improved structure of increasing an ignition capability of the spark plug to ignite a fuel mixture gas.

The present disclosure provides a spark plug has a ratio V/W within a range of $0.5<V/W<2.0$, where V indicates a length of an opposing part in a gap formation direction in which a central electrode, a discharge gap and a ground electrode having the opposing part are arranged in order, and W indicates a length of the opposing part in a ground electrode width direction.

BRIEF DESCRIPTION OF THE DRAWINGS

A preferred, non-limiting embodiment of the present disclosure will be described by way of example with reference to the accompanying drawings, in which.

DETAILED DESCRIPTION OF THE PREFERRED EMBODIMENTS

Figure 1:
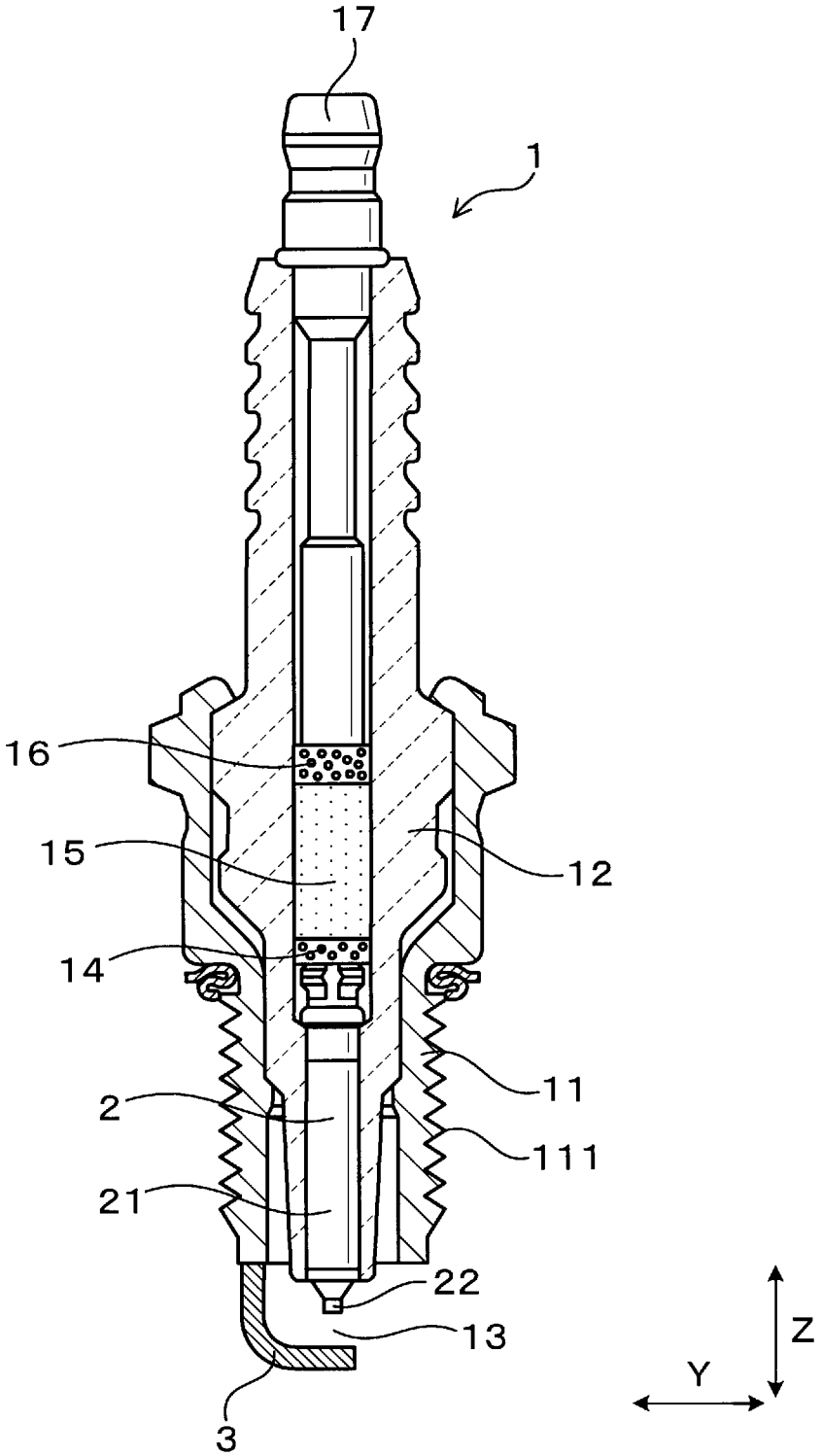
FIG. 1 is a view showing a cross section of a spark plug according to a first exemplary embodiment of the present disclosure.

Hereinafter, various embodiments of the present disclosure will be described with reference to the accompanying drawings. In the following description of the various embodiments, like reference characters or numerals designate like or equivalent component parts throughout the several diagrams.

First Exemplary Embodiment

A description will be given of a spark plug 1 according to a first exemplary embodiment of the present disclosure with reference to FIG. 1 to FIG. 4.

Figure 2:
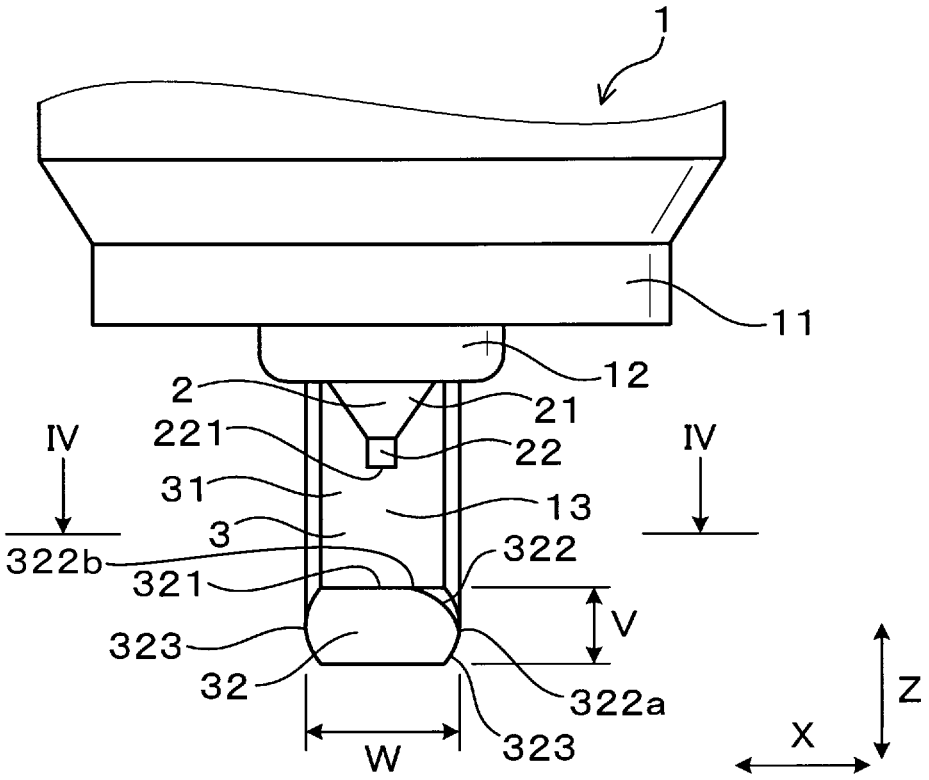
FIG. 2 is a plan view showing a front end part of the spark plug according to the first exemplary embodiment shown in FIG. 1.
Figure 3:
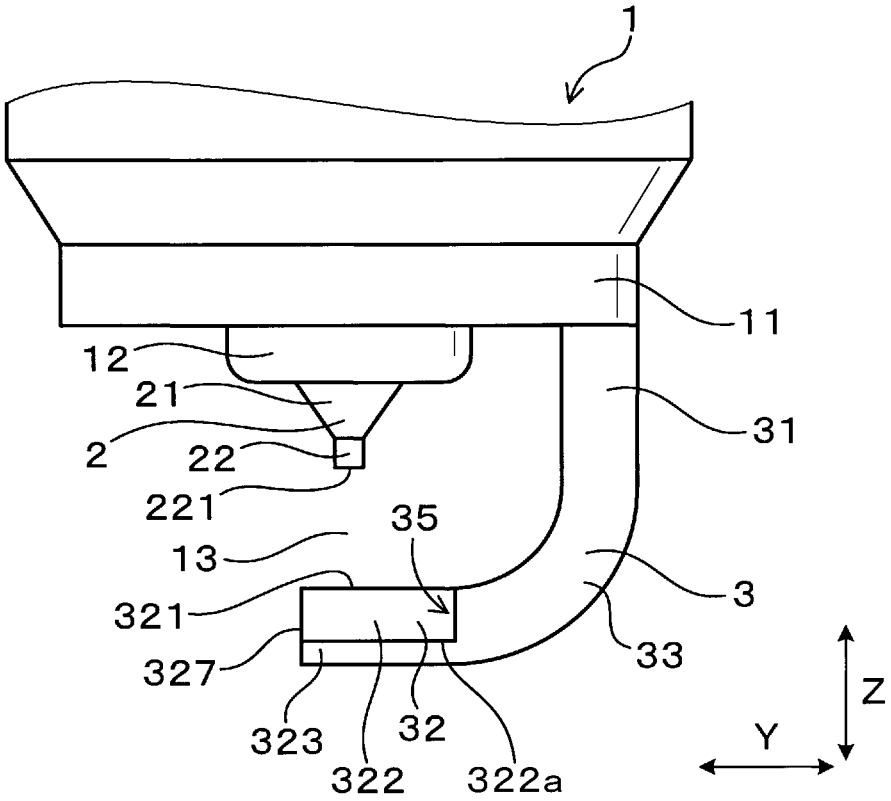
FIG. 3 is a side view showing the front end part of the spark plug according to the first exemplary embodiment shown in FIG. 1.

FIG. 1 is a view showing a cross section of the spark plug 1 according to the first exemplary embodiment. FIG. 2 is a plan view showing a front end part of the spark plug 1 according to the first exemplary embodiment shown in FIG. 1. FIG. 3 is a side view showing the front end part of the spark plug 1 according to the first exemplary embodiment shown in FIG. 1.

As shown in FIG. 1 to FIG. 3, the spark plug 1 according to the first exemplary embodiment has a spark plug housing 11, an insulator 12, a central electrode 2 and a ground electrode 3.

As shown in FIG. 1, the spark plug housing 11 has a cylindrical shape. The insulator 12 has a cylindrical shape and is arranged in and supported by the inside of the spark plug housing 11. The central electrode 2 is supported in the inside of the insulator 12 so that a front end part of the central electrode 2 projects outside of the spark plug 1.

As shown in FIG. 1 to FIG. 3, a discharge gap is formed between the central electrode 2 and the ground electrode 3.

As shown in FIG. 3, the ground electrode 3 has a rod-shaped part 31 (or a projection) and an opposing part 32. The rod-shaped part 31 extends from the front end part of the spark plug housing 11 in a plug axial direction Z of the spark plug 1. The opposing part 32 faces the central electrode 2 and has a curved shape which is curved from the rod-shaped part 31 inwardly in a radius direction of the spark plug 1. The opposing part 32 faces the central electrode 2.

Figure 4:
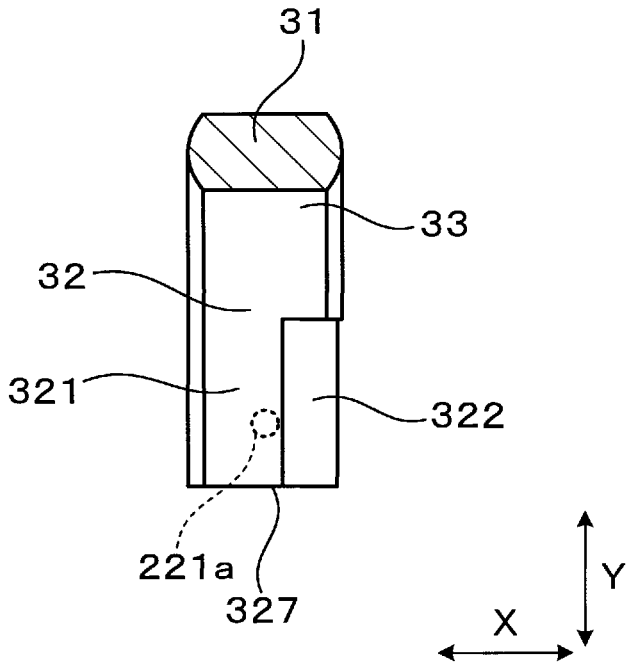
FIG. 4 is a view showing a cross section of the spark plug along the line IV-IV shown in FIG. 2.

FIG. 4 is a view showing a cross section of the spark plug 1 along the line IV-IV shown in FIG. 2.

As shown in FIG. 2 and FIG. 4, the opposing part 32 of the ground electrode 3 faces the central electrode 2. The opposing part 32 has a flat surface part 321 and a slope surface part 322. The flat surface part 321 has a flat-shaped surface. As shown in FIG. 3 and FIG. 4, the slope surface part 322 is formed on a part of the opposing part 32 along an extending direction Y of the opposing part 32. The slope surface part 322 is formed to be gradually separated from the central electrode 2, i.e., separated from the flat surface part 321 toward the end part of the opposing part 32 along a width direction of the opposing part 32. The width direction X of the opposing part 32 corresponds to and will be also referred with the ground electrode width direction X.

As shown in FIG. 2, the spark plug 1 according to the first exemplary embodiment has a ratio V/W within a range of $0.5<V/W<2.0$, where V indicates a length of the opposing part 32 in a gap formation direction in which the central electrode 2, the discharge gap 13 and the opposing part 32 are arranged in order, and W indicates a length of the opposing part 32 in the width direction X of the opposing part 32.

A description will now be given of the spark plug 1 according to the first exemplary embodiment in detail.

Hereinafter, a central axis of the spark plug 1 will be also referred to as the plug central axis. The direction, in which the plug central axis extends, corresponds to the plug axial direction Z. A radius direction of the spark plug 1 will be referred to as the plug radius direction.

For example, the spark plug 1 according to the first exemplary embodiment can be used as an ignition device of internal combustion engines of motor vehicles and co-generation systems, etc. In the plug axial direction Z, a first end part of the spark plug 1 is electrically connected to an ignition coil (not shown), and a second end part of the spark plug 1 is arranged in the combustion chamber of the internal combustion engine 101 shown in FIG. 6. Through the description of the present disclosure, the distal end part of the spark plug 1 corresponds to the ignition coil along the plug axial direction Z. The front end part of the spark plug 1 corresponds to the combustion chamber side of the internal combustion engine 101.

Figure 6:
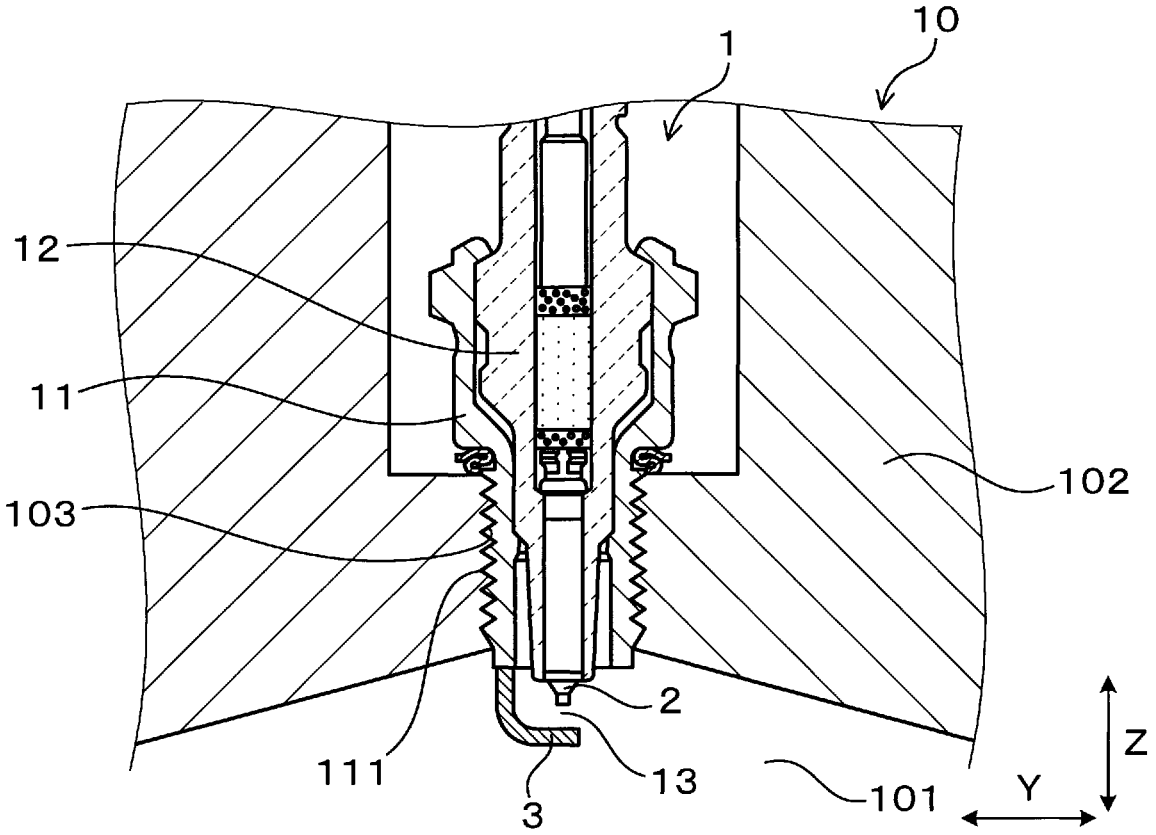
FIG. 6 is a view showing a cross section of an ignition device equipped with the spark plug according to the first exemplary embodiment.

As shown in FIG. 1, an attachment screw part 111 is formed in the spark plug housing 11, which is fitted with a female screw hole 103 shown in FIG. 6 so as to mount the spark plug 1 to the engine head part 102 shown in FIG. 6.

As shown in FIG. 1, the insulator 12 is arranged so that the front end part of the insulator 12 projects toward the front end side of the spark plug housing 11. The distal end part of the insulator 12 is arranged so that the distal end part of the insulator 12 projects toward the distal end part of the spark plug housing 11. The insulator 12 is supported by the spark plug housing 11. The central electrode 2 of the spark plug 1 is inserted into the inside of the insulator 12 and supported by the insulator 12.

As shown in FIG. 1 to FIG. 3, the central electrode 2 has a central electrode member 21 and a central electrode tip 22. The central electrode member 21 has a structure in which a metal member such as a Ni alloy is formed around a metal material made of copper, etc. The central electrode member 21 has substantially a cylindrical shape. The central axis of the central electrode member 21 is substantially equal to the plug central axis.

As shown in FIG. 1 to FIG. 3, the central electrode tip 22 is formed on and fixed to the front end part of the central electrode member 21. The central electrode tip 22 is made of a noble metal alloy such as an Ir alloy or a Pt alloy. The central electrode tip 22 has substantially a column shape and is smaller in diameter than the central electrode member 21. The central axis of the central electrode tip 22 is substantially equal to the plug central axis.

As shown in FIG. 2 and FIG. 3, a front end part 221 of the central electrode tip 22 as the front end part of the central electrode 2 is arranged facing the opposing part 32 of the ground electrode 3, and forms the discharge gap 13.

A projected circle 221*a* is designated by the dotted line shown in FIG. 4, to which the front end part 221 of the central electrode tip 22 has been projected in the plug axial direction Z.

As shown in FIG. 3, the ground electrode 3 is made of a metal plate member substantially having a letter L shape. The ground electrode 3 has been bent in a thickness direction thereof. As shown in FIG. 2, both side surfaces 323 of the ground electrode 3 in the width direction X of the opposing part 32, i.e. in the ground electrode width direction X project toward the outside of the width direction of the ground electrode 3. In more detail, both side surfaces 323 of the ground electrode 3 have curved surfaces toward the outside of the ground electrode 3.

As shown in FIG. 3, when the ground electrode 3 is produced, a metal plate member is bent in a direction perpendicular to a longitudinal direction thereof. This makes it possible to form the rod-shaped part 31 and the opposing part 32 which are connected together at the curved part 33. As shown in FIG. 3, the end part of the ground electrode 3 having the structure previously explained is joined to, i.e. fixed to the front end surface of the spark plug housing 11 at the end part of the rod-shaped part 31 in the longitudinal direction of the ground electrode 3. For example, the ground electrode 3 is made of a Ni (Nickel) based alloy.

As shown in FIG. 2 and FIG. 3, the rod-shaped part 31 extends from the spark plug housing 11 in the plug axial direction Z. A thickness direction of the rod-shaped part 31 corresponds to the plug radius direction. The opposing part 32 extends from the front end part of the rod-shaped part 31 in the plug radius direction through the curved part 33. A thickness direction of the opposing part 32 corresponds to the plug axial direction Z.

As shown in FIG. 2 and FIG. 3, the opposing part 32 faces the front end part 221 of the central electrode tip 22 in the plug axial direction Z. That is, the gap formation direction of the discharge gap formed between the central electrode 2 and the ground electrode 3 corresponds to the plug axial direction Z.

As shown in FIG. 2, the spark plug 1 according to the first exemplary embodiment has the ratio V/W within a range of $0.5<V/W<2.0$, where V indicates a length of the opposing part 32 in the gap formation direction in which the central electrode 2, the discharge gap 13 and the opposing part 32 are arranged in order, and W indicates a length of the opposing part 32 in the ground electrode width direction X. The reference character V indicates a maximum length of the opposing part 32 in the plug axial direction Z.

Figure 5:
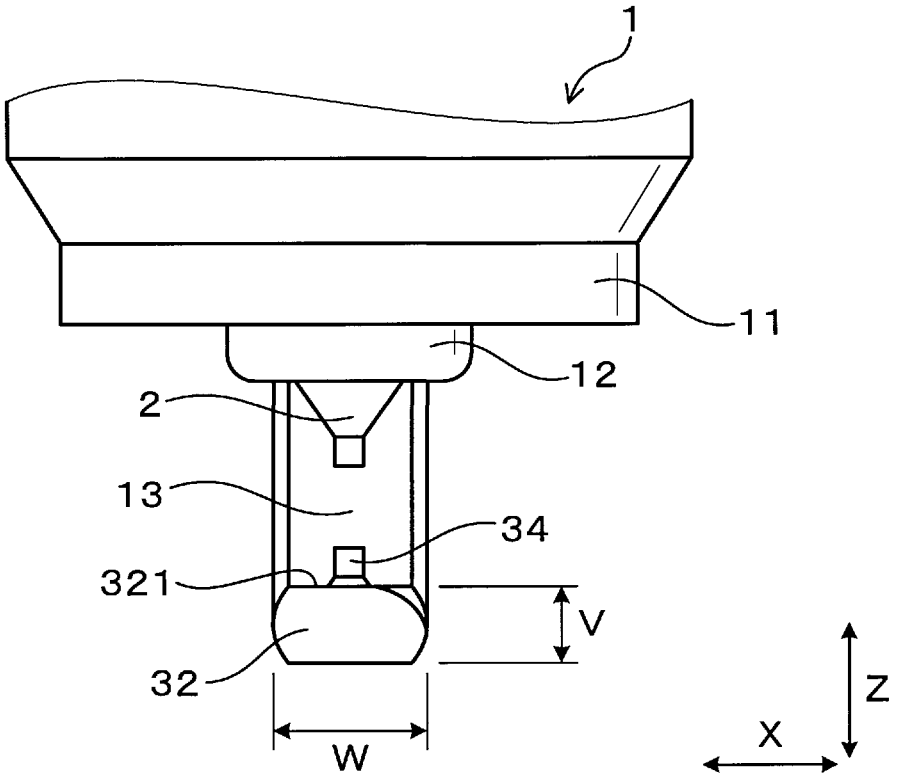
FIG. 5 is a plan view showing the front end part of the spark plug according to a modification of the first exemplary embodiment shown in FIG. 1.

FIG. 5 is a plan view showing the front end part of the spark plug according to a modification of the first exemplary embodiment shown in FIG. 1.

In a structure in which a ground electrode tip 34 is made of noble metal alloy, etc. and joined to the flat surface part 321 of the opposing part 32, the reference character V indicates the maximum length of the opposing part 32, which does not include a ground electrode tip 34 in the plug axial direction Z. The reference character W indicates the maximum length of the opposing part 32 in the width direction X of the opposing part 32.

Further, the spark plug 1 according to the first exemplary embodiment has the ratio V/W within a range of $V/W<1.7$. The spark plug 1 according to the first exemplary embodiment further has the ratio V/W within a range of $V/W<1.0$.

As shown in FIG. 2 and FIG. 4, the distal end surface of the opposing part 32 has the flat surface part 321 and the slope surface part 322. The flat surface part 321 has a flat surface shape and is formed on the flat surface of the side surface 323 of the ground electrode 3 (hereinafter, the ground side surface 323) which is perpendicular to the plug axial direction Z.

As shown in FIG. 2 to FIG. 4, the flat surface part 321 is formed to face the front end part 221 of the central electrode tip 22 in the gap formation direction which substantially corresponds to the plug axial direction Z. In the first exemplary embodiment, the flat surface part 321 faces the overall surface of the front end part 221 of the central electrode tip 22 in the plug axial direction Z.

As shown in FIG. 2, the slope surface part 322 has a curved shape and is gradually separated from the central electrode 2 side in the plug axis direction Z which is opposite to the formation direction of the flat surface part 321. In other words, the slope surface part 322 is formed from the end part 322*b* to the other end part 322*a* on the opposing part 32 and has a convex curved surface toward the central electrode 2 side. In the first exemplary embodiment, the slope surface part 322 has the curved shape, a curvature of which gradually increases from being separated from the flat surface part 321 toward the other end part 322*a* of the slope surface part 322. The flat surface part 321 and the slope surface part 322 are assembled together to have a monolithic part having a smooth surface. The slope surface part 322 can be produced by cutting a rectangle rod member which is also used for forming the ground electrode 3.

As shown in FIG. 3 and FIG. 4, the slope surface part 322 is formed at the side area of the opposing part 32 opposite to the extending direction Y of the opposing part 32. The slope surface part 322 is formed to be connected to a ground electrode end surface 327 which is opposite to the end part of the curved part 33 side when viewed in the extending direction Y of the opposing part 32.

As shown in FIG. 4, the slope surface part 322 is formed in the area from the outside of the projected circle 221*a* designated by the dotted line to the other end part of the opposing part 32 in the ground electrode width direction X. As shown in FIG. 4, a boundary line between the flat surface part 321 and the slope surface part 322 is located outside of the projected circle 221*a* when viewed along the width direction X of the opposing part 32.

As shown in FIG. 2 and FIG. 3, the end part 322*a* of the slope surface part 322 which is opposite to the flat surface part 321 side when viewed from the ground electrode width direction X is connected to the ground side surface 323 in the ground electrode 3.

The slope surface part 322 is formed so that the end part 322*a* of the slope surface part 322, which is opposite to the end part 322*b* formed at the flat surface part 321 side when viewed in the ground electrode width direction X, is located at a front part when viewed from a central position of the opposing part 32 in the plug axial direction Z of the spark plug 1. That is, the end part 322*b* of the slope surface part 322, formed at the flat surface part 321 side when viewed in the ground electrode width direction X, is formed at the central electrode 2 side when viewed from the central line of the opposing part 32 in the plug axis direction Z (see FIG. 3), and the other end part 322*a* of the slope surface part 322 is formed at the bottom side of the opposing part 32 when viewed from the central line of the opposing part 32 in the plug axis direction Z (see FIG. 3).

As shown in FIG. 1, a resistor part 15 is arranged in a glass seal part 14 having a conductive property at the distal end side of the central electrode 2 in the inside of the insulator 12.

It is possible to produce the resistor part 15 by heating and sealing a resistor compound which contains a resistance member and glass powder. The resistance member may be carbon or ceramic powders. It is also possible to insert a cartridge-type resistance member.

The glass seal part 14 is made of a copper glass. The copper glass is made of a mixture of a glass and copper. A stem 17 is arranged at the distal end side of the resistor part 15 through a glass seal 16 made of copper glass.

A description will be given of an ignition device 10 equipped with the spark plug 1 according to the first exemplary embodiment with reference to FIG. 6. The ignition device 10 is mounted on an internal combustion engine.

FIG. 6 is a view showing a cross section of the ignition device 10 equipped with the spark plug 1 according to the first exemplary embodiment shown in FIG. 1.

The spark plug 1 has an attaching screw part 111 which has been screwed to a female screw hole 103 formed in the engine head 102 of the internal combustion engine. This makes it possible to fasten the spark plug 1 to the engine heat 102 so that the front end part of the spark plug 1 is arranged in the inside of the combustion chamber 101 of the internal combustion engine.

Figure 7:
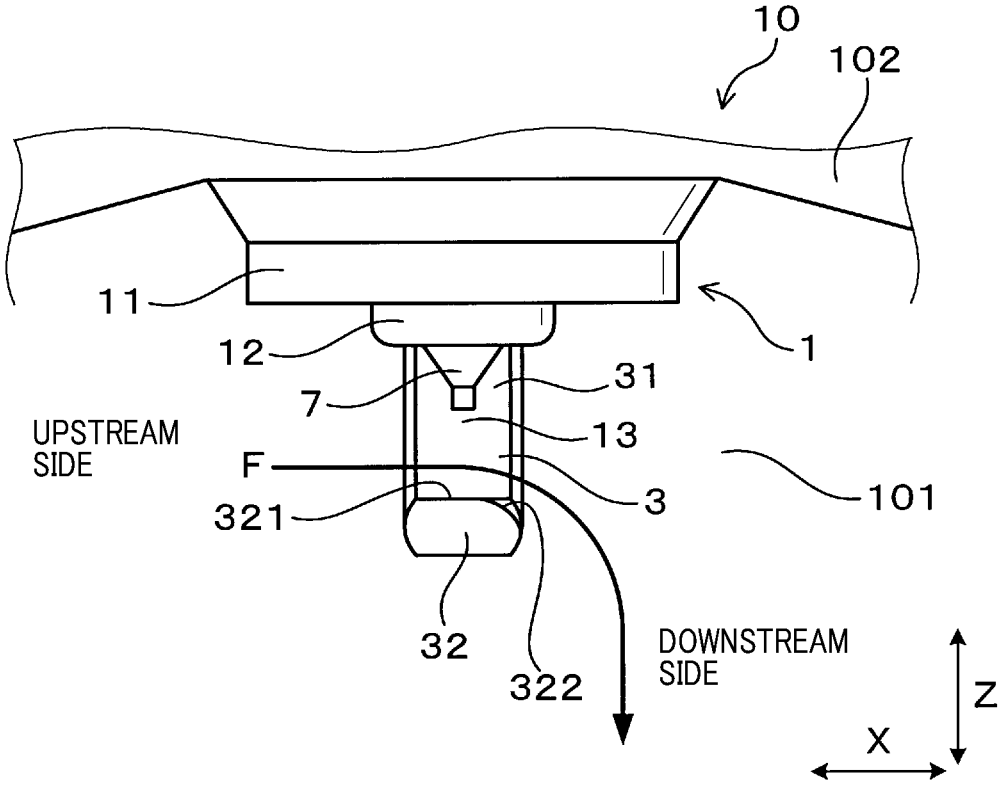
FIG. 7 is an enlarged plan view showing a flow of a fuel mixture gas designated by an arrow and showing a schematic structure of the front end part of the spark plug according to the first exemplary embodiment.

FIG. 7 is an enlarged plan view showing a flow of a fuel mixture gas designated by the arrow. FIG. 7 shows a schematic structure of the front end part of the spark plug 1 according to the first exemplary embodiment.

As shown in FIG. 7, the spark plug 1 is arranged in the combustion chamber 101 so that the slope surface part 322 is arranged at the downstream side of the fuel mixture gas passing through the discharge gap 13 when viewed from the flat surface part 321 in the ground electrode width direction X. That is, the slope surface part 322 is arranged to be separated from the central electrode 2 side along the direction of the flow F of the fuel mixture gas and in the plug axial direction Z of the spark plug 1.

The flow F of the fuel mixture gas is flowing to the front end part of the spark plug 1 at the engine ignition time. Hereinafter, the flow F of the fuel mixture gas indicates the flow of the fuel mixture gas passing through the front end part of the spark plug 1 at the engine ignition time. The flow F of the fuel mixture gas is passing from the upstream side at the left-hand side to the downstream side at the right-hand side shown in FIG. 7.

It is possible to adjust the attaching direction of the spark plug 1 to the internal combustion engine by adjusting the direction of the attachment screw part 111 formed in the spark plug housing 11 while considering the flow F of the fuel mixture gas in the combustion chamber 101 of the internal combustion engine.

A description will be given of the flow F of the fuel mixture gas around the discharge gap 13 between the central electrode 2 and the ground electrode 3 with reference to FIG. 7.

At the upstream side of the flow F of the fuel mixture gas when viewed from the discharge gap 13, the fuel mixture gas flows in the ground electrode width direction X. When the spark plug 1 is attached to the combustion chamber 101 in the direction previously described, the flow F of the fuel mixture gas is smoothly flowing along the flat surface part 321 and the slope surface part 322 when the fuel mixture gas is passing in the discharge gap 13. Accordingly, as designated by the arrow shown in FIG. 7, the flow F of the fuel mixture gas is gradually curved at the front end side of the spark plug 1 toward the downstream side when viewed from the plug axial direction Z of the spark plug 1. At the downstream side, the flow F of the fuel mixture gas is flowing along the plug axial direction Z of the spark plug 1 toward the front end side of the spark plug 1 as designated by the arrow shown in FIG. 7.

A description will now be given of the phenomenon of extension of a spark discharge S generated in the discharge gap 13 by the flow F of the fuel mixture gas with reference to FIG. 8 to FIG. 10.

Figure 8:
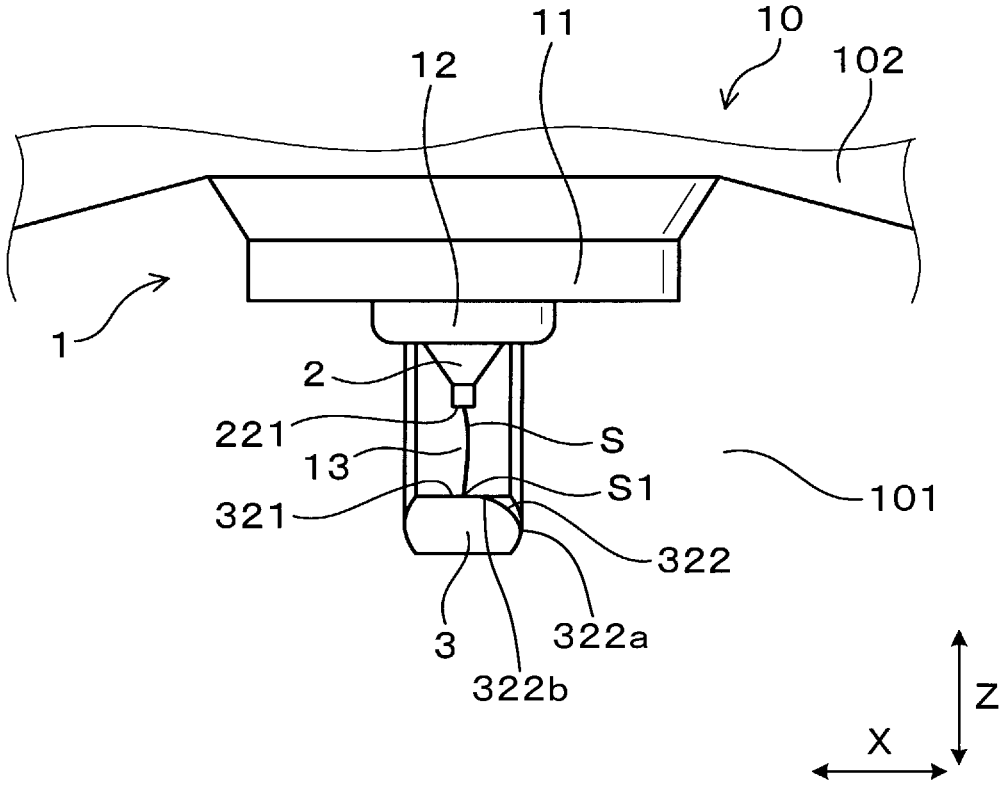
FIG. 8 is a view showing an enlarged plan view around the front end part of the spark plug according to the first exemplary embodiment in the ignition device and showing an initial state of a spark discharge.

FIG. 8 is a view showing an enlarged plan view around the front end part of the spark plug 1 according to the first exemplary embodiment in the ignition device and showing an initial state of the spark discharge S.

As shown in FIG. 8, the spark discharge S is generated in the discharge gap 13 when a predetermined voltage is applied between the central electrode 2 and the ground electrode 3. The spark discharge S is easily generated between the front end part 221 of the central electrode tip 22 and the flat surface part 321 of the ground electrode 3 at the initial state of the spark discharge S. That is, because a minimum-distance gap is formed between the front end part 221 and the flat surface part 321 in the discharge gap 13 between the central electrode 2 and the ground electrode 3, the spark discharge easily occurs at the minimum-distance gap formed between the front end part 221 and the flat surface part 321 at the beginning state of the spark discharge. Hereinafter, the start point of the spark discharge S at the ground electrode 3 side will be referred to as the start point S1 of the spark discharge S at the ground electrode side.

Figure 9:
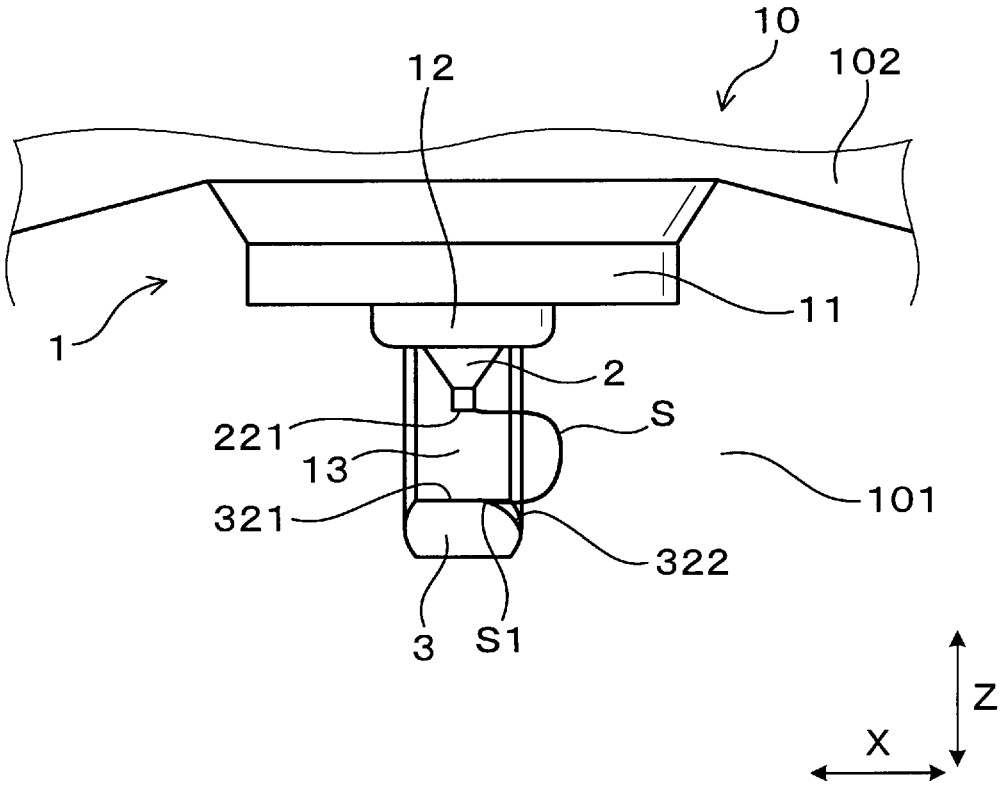
FIG. 9 is a view showing an enlarged plan view around the front end part of the spark plug according to the first exemplary embodiment in the ignition device and showing the initial state of the spark discharge extended in a downstream side due to a flow of the fuel mixture gas.

FIG. 9 is a view showing an enlarged plan view around the front end part of the spark plug 1 according to the first exemplary embodiment in the ignition device. FIG. 9 shows the initial state of the spark discharge S extended toward the downstream side due to the flow F of the fuel mixture gas.

As shown in FIG. 8 and FIG. 9, the start point S1 of the spark discharge S at the ground electrode side is moved toward the downstream side from the flat surface part 321 due to the flow F of the fuel mixture gas, and finally reaches the boundary part between the flat surface part 321 and the slope surface part 322, i.e. reaches the end part 322*b* of the slope surface part 322.

Figure 10:
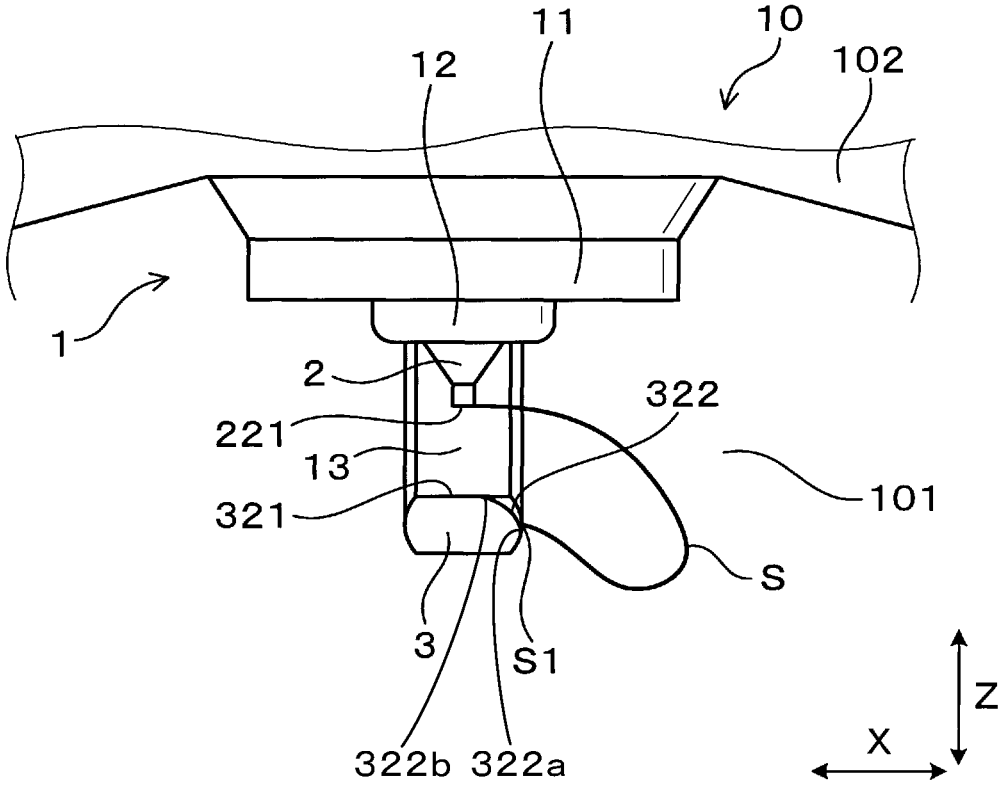
FIG. 10 is a view showing an enlarged plan view around the front end part of the spark plug according to the first exemplary embodiment in the ignition device and showing that the spark is blown downstream and deviated slightly in an axial direction of the spark plug due to the flow of the fuel mixture gas.

FIG. 10 is a view showing an enlarged plan view around the front end part of the spark plug 1 according to the first exemplary embodiment in the ignition device. FIG. 10 shows the spark discharge S which has been moved in a direction substantially parallel to the plug axial direction Z of the spark plug 1.

As shown in FIG. 9 and FIG. 10, the start point S1 of the spark discharge S is further moved along the slope surface part 322 toward the downstream side due to the flow F of the fuel mixture gas. This phenomenon makes it possible to gradually increase a distance between the start point S1 of the spark discharge S and the current position of the spark discharge S and to expand the area of the spark discharge S toward the downstream side.

As shown in FIG. 10, when the expanded spark discharge S reaches the other end part 322*a* of the slope surface part 322, which is opposite to the end part 322*b* of the slope surface part 322 located at the flat surface part 321 side in the ground electrode width direction X, the spark discharge S is expanded approximately toward the front end part of the spark plug 1 in the plug axial direction Z of the spark plug 1, i.e. to be separated from the engine head 102. As previously described, the fuel gas mixture starts to ignite due to the spark discharge S while the spark discharge S is expanded due to the flow F of the fuel mixture gas.

In the spark plug 1 according to the first exemplary embodiment previously described, it is possible to increase the discharge area of the because the start point S1 of the spark discharge S is moved due to the flow F of the fuel mixture gas. This makes it possible to prevent a short circuit from occurring at an earlier timing between parts of the spark discharge S when the spark discharge S is expanded toward the downstream side of the flow F of the fuel mixture gas. It is accordingly to expand the spark discharge S to be as large as possible. Further, because the spark discharge S is greatly expanded when the spark discharge S is separated from the engine head 102, it is possible to prevent the engine head 102 from absorbing the thermal energy of flame which has been generated when the spark discharge S ignites the fuel mixture gas. This makes it possible to promote the flame generated when the spark discharge S ignites the fuel mixture gas Further, the improved structure of the spark plug 1 according to the first exemplary embodiment has the ratio V/W within the range of $0.5<V/W<2.0$, where V indicates the length of the opposing part 32 in the gap formation direction in which the central electrode 2, the discharge gap 13 and the opposing part 32 are arranged in order, and W indicates the length of the opposing part 32 in the width direction X of the opposing part 32. This makes it possible to prevent a short circuit between a part of the spark discharge S and a part of the ground electrode 3 from being generated due to the increasing of the size of the opposing part 32 and the projected part of the ground electrode 3 in the expansion direction of the spark discharge S.

Next, a description will be given of the behavior and effects of the spark plug 1 according to the first exemplary embodiment.

The spark plug 1 according to the first exemplary embodiment has the ground electrode 3 which is composed of the flat surface part 321 and the slope surface part 322. The spark plug 1 has the improved structure which has the ratio V/W within the range of 0.5<V/W<2.0. The improved structure makes it possible to improve the ignition capability of the spark plug 1 to ignite the fuel mixture gas. Various ranges of the ratio V/W have been supported on the basis of a plurality of experimental results which will be explained later.

The slope surface part 322 is formed in the extending direction Y on a part of the opposing part 32 of the ground electrode 3. As shown in FIG. 3, a step-shaped part 35 is formed in the extending direction Y between the slope surface part 322 and a part of the opposing part 32 which is adjacent to the slope surface part 322, not at the rod-shaped part 31 side of the ground electrode 3. Accordingly, the structure of the step-shaped part 35 prevents the start point S1 of the spark discharge S from being moved toward the rod-shaped part 31 side in the longitudinal direction of the ground electrode 3 due to the flow F of the fuel mixture gas. This makes it possible to prevent the start point S1 of the spark discharge S from being expanded along the rod-shaped part 31 to the distal end part of the spark plug 1. This makes it possible to easily expand the spark discharge S away from the engine head 102 side.

Further, the spark plug 1 according to the first exemplary embodiment has the ratio V/W within a range of V/W<=1.7. Still further, the spark plug 1 according to the first exemplary embodiment has the ratio V/W within a range of V/W>1.0. This makes it possible to further improve the ignition capability of the spark plug 1. The specific ranges of the ratio V/W have been obtained on the basis of various experimental results which will be explained later.

In the structure of the spark plug 1 according to the first exemplary embodiment, the flat surface part 321 is formed in the ground electrode 3 so that the central axis of the flat surface part 321 and the central axis of the front end surface of the central electrode 2 coincide together in the gap formation direction in which the discharge gap is formed between the central electrode 2 and the ground electrode 3. This makes it possible to easily shorten the gap between the front end surface of the central electrode 2 and the flat surface part 321 formed on the ground electrode 3, and to easily generate the spark discharge S at the initial state thereof between the front end surface of the central electrode 2 and the flat surface part 321. The generation of the spark discharge S around the flat surface part 321 makes it possible to prevent occurrence of abrasion in a part of the ground electrode 3.

On the other hand, in a structure of a related-art spark plug in which a corner part is formed on the surface of the ground electrode 3 at the central electrode 2 side and the front end part of the central electrode 2 and the corner part of the ground electrode 3 coincide together in the gap formation direction, the spark discharge S is easily generated around the corner part because electric fields are concentrated at the corner part. In this structure, because the spark discharge is easily generated repeatedly at the corner part of the ground electrode 3, it is possible to progress abrasion of the ground electrode 3.

As previously described, the ground electrode 3 and the central electrode 2 in the spark plug 1 according to the first exemplary embodiment having the improved structure have no part to which electric fields are concentrated. In other words, because the flat surface part 321 of the ground electrode 3 has no part at which electric fields are concentrated, it is possible to prevent the spark discharge from being concentrated at a part on the flat surface part 321 and to prevent local abrasion from being on the flat surface part 321 of the ground electrode 3.

As previously described in detail, the first exemplary embodiment provides the spark plug 1 having the improved structure and improved ignition capability. It is possible to use the spark plug 1 according to the first exemplary embodiment in various types of internal combustion engines.

Experimental Results

Various experiments have been performed. The experiments prepared and evaluated eight spark plugs (test samples 1 to 8), each of which had the ground electrode 3 of a different structure. The experiments detected the ignition capability of each of the test samples 1 to 8 on the basis of a detection result of its air/fuel (A/F) limit value. The A/F limit value represents a limit value of the air/fuel ratio when a correct combustion was generated. The greater the A/F limit value is, the higher the combustion performance of the spark plug is. The correct combustion represents a combustion variable rate of not more than 3%. The combustion variable rate represents a value of [(a standard deviation/average value)×100% of an average effective pressure Pmi].

Table 1 shows the structure of each of the test samples 1 to 8. That is, each of the test samples 1 to 8 had a different structure. Each of the eight test samples 1 to 8 has a basic structure which was the same of the basic structure of the spark plug 1 according to the first exemplary embodiment. As shown in Table 1, each of the eight test samples 1 to 8 has the opposing part 32 of a different length V measured in the plug axial direction Z and of a different length W measured in the ground electrode width direction X, i.e. in the width direction X of the opposing part 32. Each of the eight test samples 1 to 8 had a part of the opposing part 32, where no slope surface part 322 was formed, has the same cross sectional area when viewed in the direction which is perpendicular to the extending direction Y.

The cross sectional area of the part of the opposing part 32, where no slope surface part 322 was formed and perpendicular to the extending direction Y, corresponds to a cross sectional area of the ground electrode 3 perpendicular to the longitudinal direction of the ground electrode 3 of the spark plug 1.

TABLE 1

| Test samples No. | V/W | V(mm) | W(mm) |
|---|---|---|---|
| 1 | 0.4 | 1.2 | 3 |
| 2 | 0.5 | 1.4 | 2.8 |
| 3 | 1 | 2 | 2 |
| 4 | 1.7 | 2.6 | 1.5 |
| 5 | 1.9 | 2.2 | 1.17 |
| 6 | 2 | 1.5 | 0.75 |
| 7 | 2.4 | 3.1 | 1.3 |
| 8 | 3.7 | 3.7 | 1 |

The test samples 1 to 8 were formed so that the smaller the ratio V/W is (i.e. when the opposing part 32 becomes laterally wide), the longer the lateral length of the slope surface part 322, and on the other hand, the greater the ratio V/W is (i.e. when the opposing part 32 becomes vertically long), the longer the vertical length of the slope surface part 322. Accordingly, the test sample 1 having the ratio V/W of a small value has a long lateral shape. On the other hand, the test sample 8 having the ratio V/W of a large value has a long vertical shape.

In the experiments, each of the test samples 1 to 8 was mounted on a 2500 cc petrol engine. Each of the test samples 1 to 8 was mounted to the petrol engine so that the extending direction Y of the opposing part 32 to the curved part 33 in the ground electrode 3 become perpendicular to the flow F of the fuel mixture gas in the discharge gap 13. Further, each of the test samples 1 to 8 was arranged at the central part of the combustion chamber of the petrol engine.

The experiments detected a combustion variation on the basis of output values of a combustion pressure sensor while changing the A/F value, and detected the A/F limit value. The test samples 1 to 8 had the same combustion conditions in each test cycle. That is, the experiments used the same conditions, i.e. the same intake air amount, the same fuel injection amount, the same open/close timing of intake and exhaust valves, the same engine revolution of 2800 rev/min and the same average effective pressure Pmi of 500 kPa.

Figure 11:
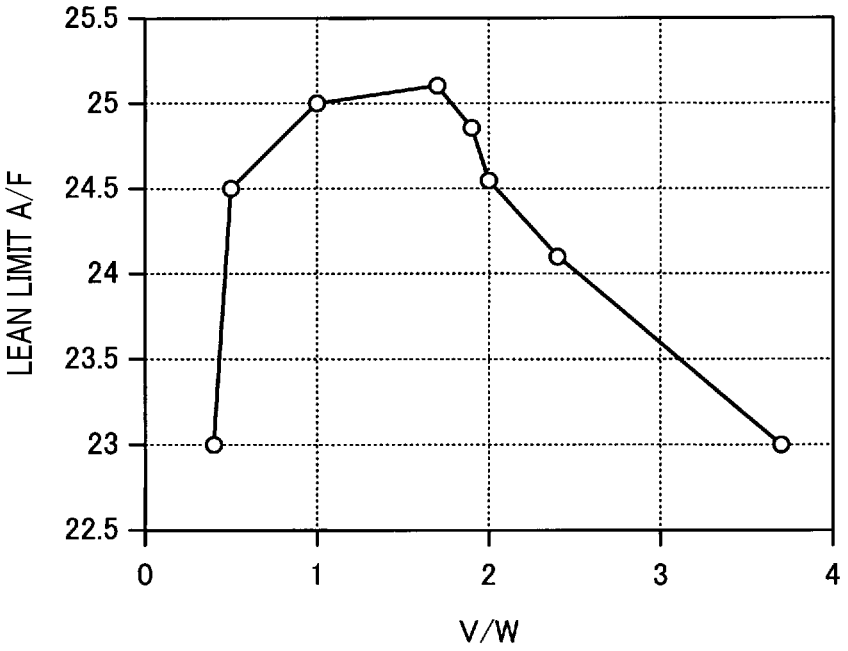
FIG. 11 is a graph showing experimental results regarding a relationship between a ratio V/W and a lean limit A/F ratio.

FIG. 11 is a graph showing the experimental results of the test samples 1 to 8 regarding the relationship between the ratio V/W and the lean limit A/F ratio.

From the experimental results shown in FIG. 11, it can be clearly recognized that the test samples 2 to 6, which has the ratio V/W within the range of 0.5<=V/W<=2.0, have a high lean limit A/F ratio of not less than 24.5.

In the experimental results shown in FIG. 11, because the lean limit A/F ratio drastically drops when the ratio V/W is more than 1.7, it can be understood to easily increase the lean limit A/F ratio when the ratio V/W is not more than 1.7 (V/W<=1.7).

Further, in the experimental results shown in FIG. 11, because the lean limit A/F ratio drastically drops when the ratio V/W is less than 1.0, it can be understood to easily increase the lean limit A/F ratio when the ratio V/W is not less than 1.0 (V/W>=1.0).

Still further, in the experimental results shown in FIG. 11, because the test samples 3 and 4, which has the ratio V/W within the range of 1.0<=V/W<=1.7, have a high lean limit A/F ratio of not less than 25, it can be understood to obtain a higher lean limit A/F ratio when the ratio V/W is within the range of 1.0<=V/W<=1.7.

Second Exemplary Embodiment

A description will be given of the spark plug according to the second exemplary embodiment of the present disclosure with reference to FIG. 12.

Figure 12:
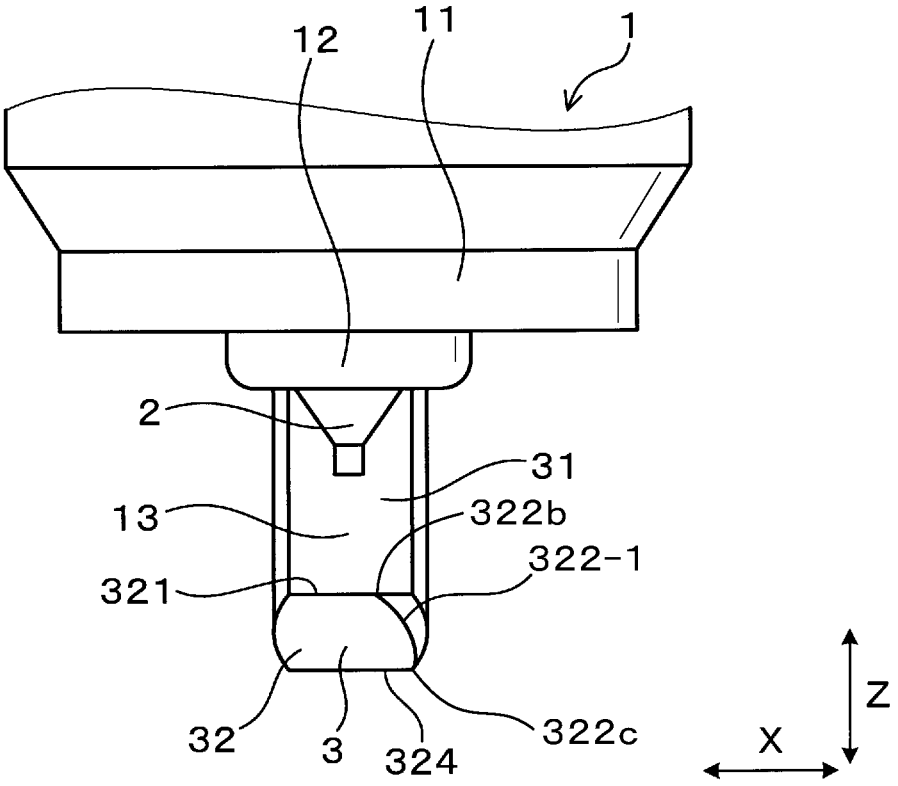
FIG. 12 is a plan view showing a front end part of the spark plug according to a second exemplary embodiment of the present disclosure.

FIG. 12 is a plan view showing the front end part of the spark plug 1 according to a second exemplary embodiment of the present disclosure. As shown in FIG. 12, the spark plug 1 according to the second exemplary embodiment is different in shape of the slope surface part from the spark plug 1 according to the first exemplary embodiment.

As shown in FIG. 12, the spark plug 1 according to the second exemplary embodiment has an improved structure in which a slope surface part 322-1 has the end part 322*b* (as a first end part) and the other end part 322*c* (as a second end part). The first end part 322*b* of the slope surface part 322-1 is connected to an end part of the flat surface part 321 in the width direction X of the opposing part 32. The second end part 322*c* of the slope surface part 322-1 is connected to an end part on a back surface 324 of the opposing part 32, which is opposite to a front surface (as the flat surface part 321) of the opposing part 32 which faces the central electrode 2 side in the gap formation direction, i.e. in the plug axial direction Z.

The slope surface part 322-1 is formed so that the second end part 322*c* of the slope surface part 322-1, opposite to the flat surface part 321 side on the opposing part 32, is connected to the back surface 324 of the ground electrode 3. The back surface 324 of the ground electrode 3 is the bottom-side surface of the ground electrode 3, which is opposite to the front surface of the opposing part 32 in the discharge gap formation direction, i.e. in the plug axial direction Z. In other words, the first end part 322*b* of the slope surface part 322-1 is connected to the flat surface part 321, and the second end part 322*c* of the slope surface part 322-1 is connected to the back surface 324 of the ground electrode 3.

Other components of the spark plug 1 according to the second exemplary embodiment are the same of those of the spark plug 1 according to the first exemplary embodiment. The same components between the first exemplary embodiment and the second exemplary embodiment will be referred with the same reference numbers and characters. The explanation of these same components between the first exemplary embodiment and the second exemplary embodiment is omitted here for brevity.

The structure of the slope surface part 322-1 formed in the ground electrode 3 makes it possible to easily move the start point S1 of the spark discharge S at the ground electrode side toward the front end side of the ground electrode 3. This makes it possible to easily keep the distance between the start point S1 of the spark discharge S at the ground electrode 3 and the start point of the spark discharge at the central electrode 2. This allows the size of the spark discharge S toward the front end side to expand toward the front end side. It is accordingly possible for the spark plug 1 according to the second exemplary embodiment to have an improved ignition capability.

In addition, the spark plug 1 according to the second exemplary embodiment has the same behavior and effects of the spark plug 1 according to the first exemplary embodiment.

Third Exemplary Embodiment

A description will be given of the spark plug according to a third exemplary embodiment of the present disclosure with reference to FIG. 13 to FIG. 16.

The spark plug 1 according to the third exemplary embodiment is different in shape of the slope surface part from the spark plug 1 according to the first exemplary embodiment.

Figure 13:
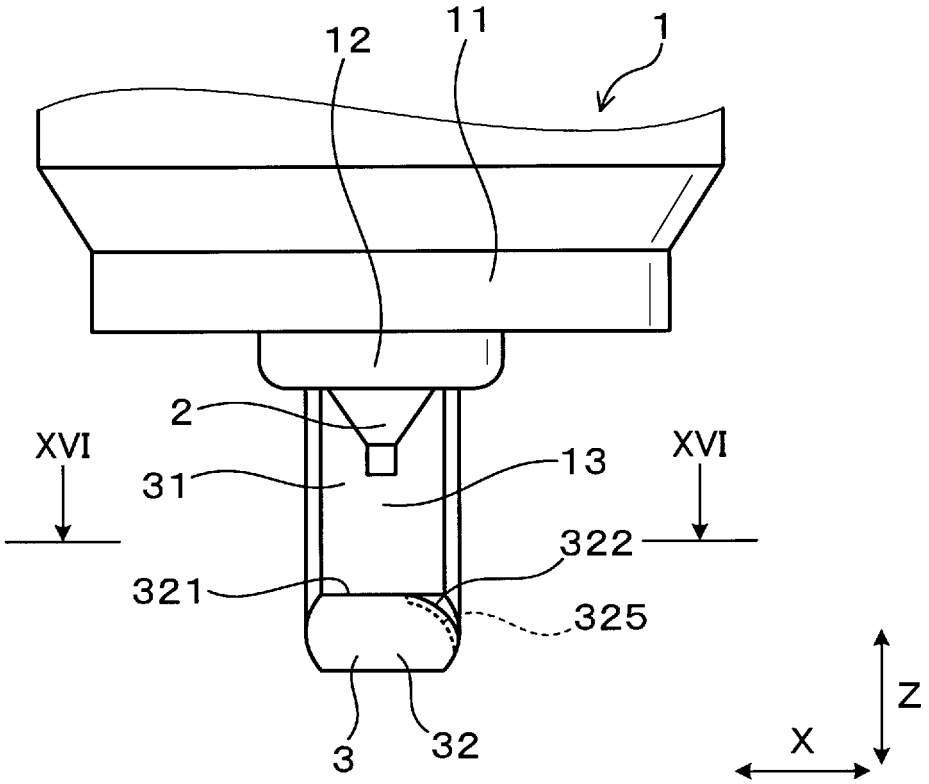
FIG. 13 is a plan view showing a front end part of the spark plug according to a third exemplary embodiment of the present disclosure.
Figure 14:
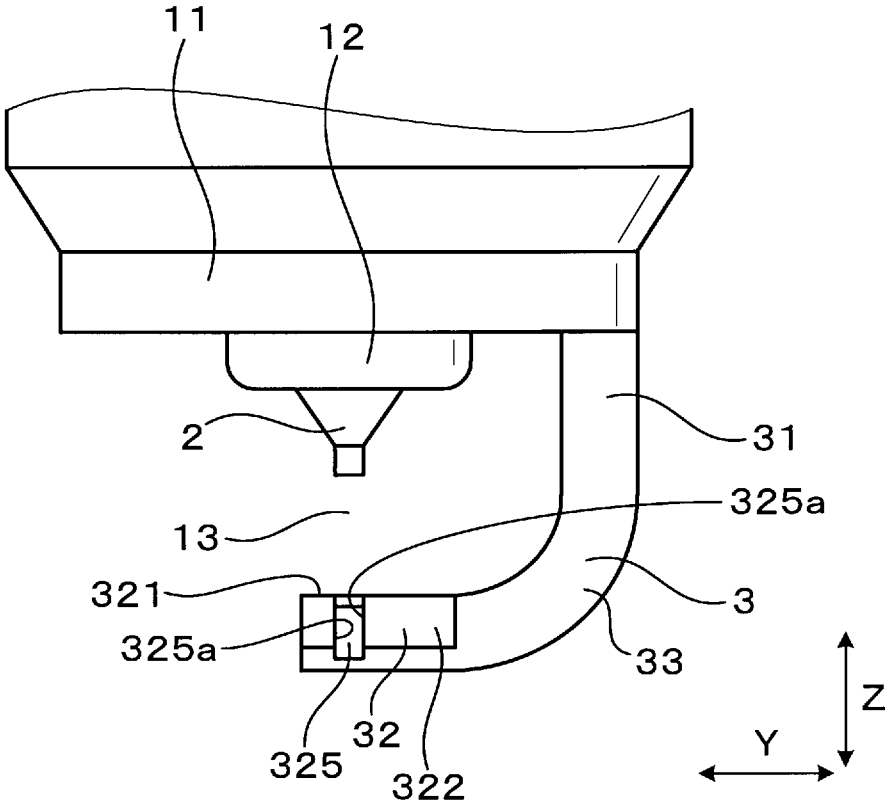
FIG. 14 is a side view showing the front end part of the spark plug according to the third exemplary embodiment shown in FIG. 13.
Figure 15:
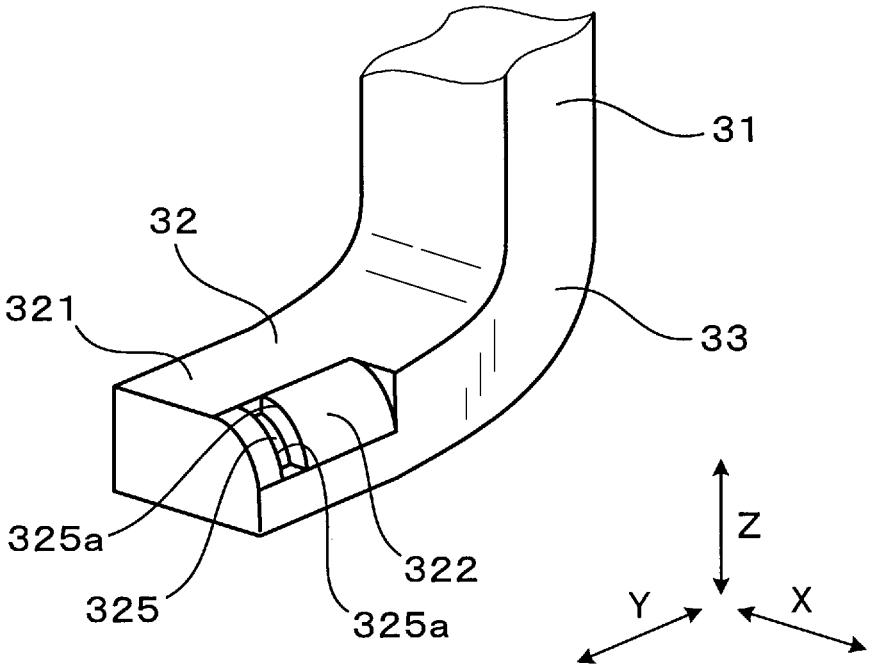
FIG. 15 is a perspective view showing a ground electrode of the spark plug according to the third exemplary embodiment.
Figure 16:
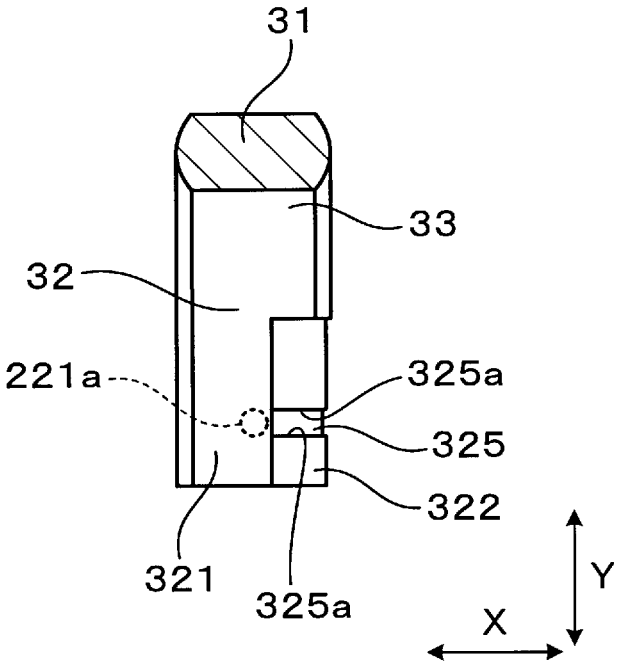
FIG. 16 is a view showing a cross section of the spark plug along the line XVI-XVI shown in FIG. 13.

FIG. 13 is a plan view showing the front end part of the spark plug 1 according to the third exemplary embodiment of the present disclosure. FIG. 14 is a side view showing the front end part of the spark plug 1 shown in FIG. 13. FIG. 15 is a perspective view showing the ground electrode 3 of the spark plug 1 shown in FIG. 13. FIG. 16 is a view showing a cross section of the spark plug 1 along the line XVI-XVI shown in FIG. 13.

As shown in FIG. 13 to FIG. 16, a recessed part 325 is formed in the slope surface part 322 of the ground electrode 3 in the spark plug 1 according to the third exemplary embodiment. The recessed part 325 is continuously formed from the end part of the flat surface part 321 to the end part of the back surface of the ground electrode 3. The recessed part 325 is designated by the dotted line shown in FIG. 13.

As shown in FIG. 15, the slope surface part 322 has the curved shape and the recessed part 325 has a groove shape and is formed in its longitudinal direction toward the curved part of the slope surface part 322. The recessed part 325 is open toward the front end part along the plug axial direction Z of the spark plug 1 when being separated from the flat surface part 321 in the ground electrode width direction X. That is, the recessed part 325 is open toward the normal line of the slope surface part 322.

As shown in FIG. 14 to FIG. 16, edge parts 325*a* are formed in the opening part of the recessed part 325. As shown in FIG. 15, both the edge parts 325*a* formed in the extending direction Y of the recessed part 325 are formed along the curved direction of the slope surface part 322. That is, both the edge parts 325*a* formed at the both sides of the recessed part 325 in the extending direction Y is curved toward the front end side in the plug axial direction Z of the spark plug 1 while separated from the flat surface part 321 of the ground electrode 3 in the ground electrode width direction X.

As shown in FIG. 16, the recessed part 325 is formed at an area adjacent in the ground electrode width direction X to the projected circle 221*a* of the front end surface 221. The recessed part 325 is also formed in the area opposite to the curved part 33 side when viewed from the central part of the slope surface part 322 in the extending direction Y.

Other components of the spark plug 1 according to the third exemplary embodiment are the same of those of the spark plug 1 according to the first exemplary embodiment. The same components between the first exemplary embodiment and the third exemplary embodiment will be referred with the same reference numbers and characters. The explanation of these same components between the first exemplary embodiment and the third exemplary embodiment is omitted here for brevity.

Because the structure of the spark plug 1 according to the third exemplary embodiment allows electric fields to be concentrated around the edge parts 325*a* of the recessed part 325, this makes it possible to easily and stably move the start point S1 of the spark discharge S at the ground electrode 3 side. This structure makes it possible to easily separate the start point S1 of the spark discharge S at the ground electrode 3 side from the start point of the spark discharge at the central electrode 2 side. Further, this structure makes it possible to improve the ignition capability of the spark plug 1 to ignite the fuel mixture gas.

Further, the spark plug 1 according to the third exemplary embodiment has the same behavior and effects of the spark plug 1 according to the first exemplary embodiment.

Fourth Exemplary Embodiment

A description will be given of the spark plug according to a fourth exemplary embodiment of the present disclosure with reference to FIG. 17 to FIG. 20.

The spark plug 1 according to the fourth exemplary embodiment is different in shape of the slope surface part from the spark plug 1 according to the first exemplary embodiment.

Figure 17:
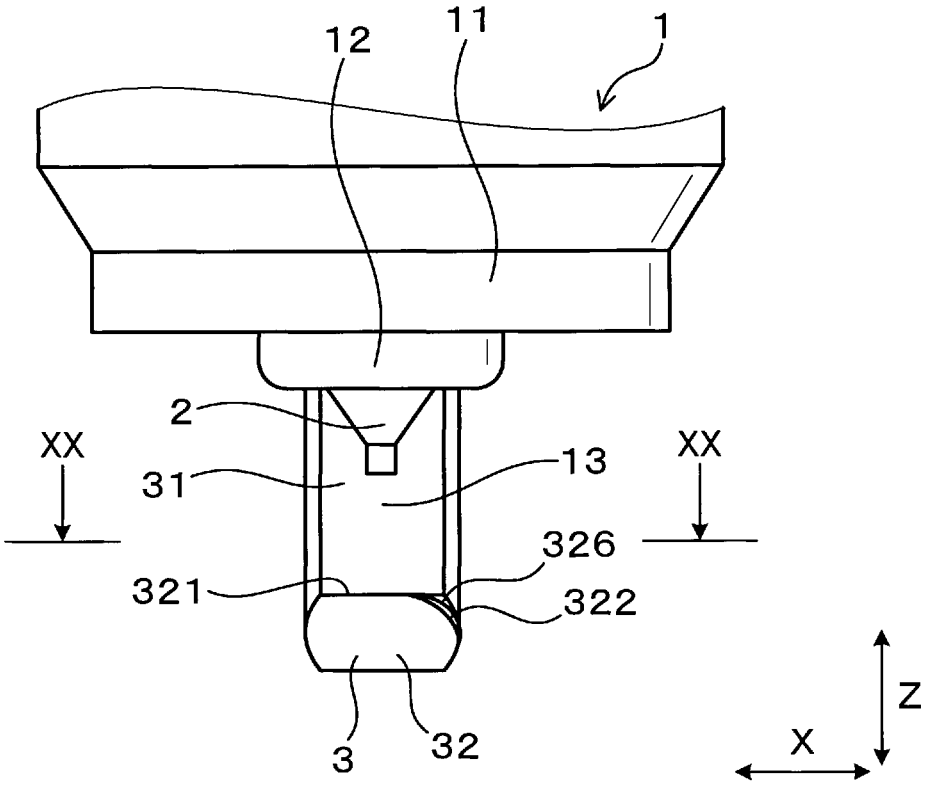
FIG. 17 is a plan view showing a front end part of the spark plug according to a fourth exemplary embodiment of the present disclosure.
Figure 18:
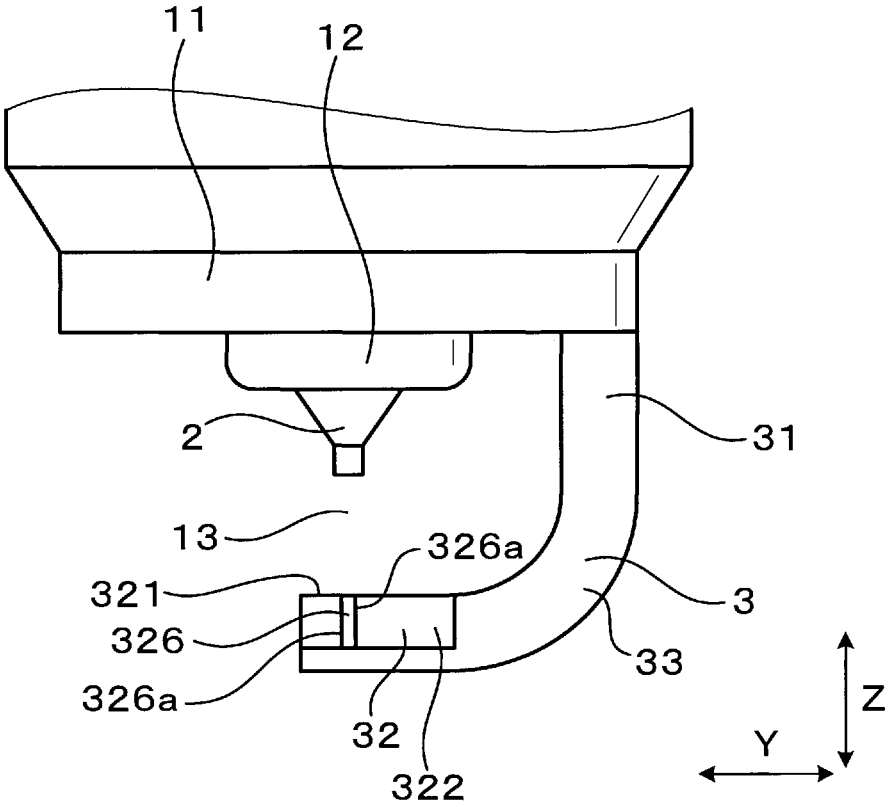
FIG. 18 is a side view showing the front end part of the spark plug according to the fourth exemplary embodiment shown in FIG. 17.

FIG. 17 is a plan view showing a front end part of the spark plug 1 according to the fourth exemplary embodiment of the present disclosure. FIG. 18 is a side view showing the front end part of the spark plug 1 shown in FIG. 17.

As shown in FIG. 17 and FIG. 18, a protruded part 326 is continuously formed in the slope surface part 322 of the ground electrode 3 in the spark plug 1 according to the fourth exemplary embodiment. That is, the protruded part 326 is continuously formed from the end part of the flat surface part 321 to the end part of the back surface of the ground electrode 3.

Figure 19:
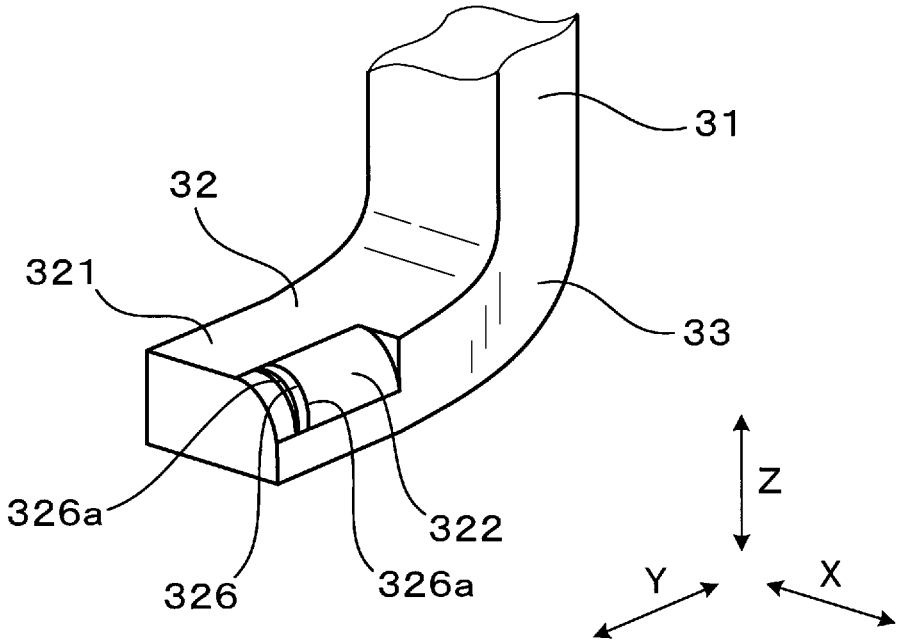
FIG. 19 is a perspective view showing a ground electrode of the spark plug according to the fourth exemplary embodiment.
Figure 20:
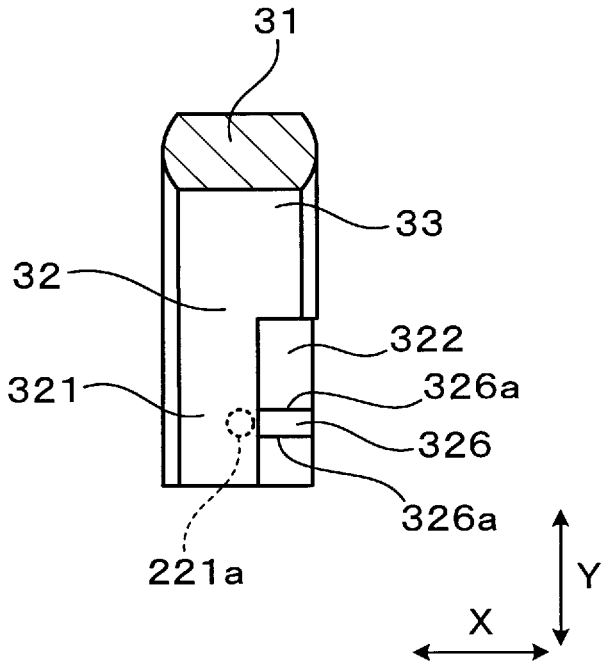
FIG. 20 is a view showing a cross section of the spark plug along the line XX-XX shown in FIG. 17.

FIG. 19 is a perspective view showing the ground electrode 3 of the spark plug 1 shown in FIG. 17. FIG. 20 is a view showing a cross section of the spark plug 1 along the line XX-XX shown in FIG. 17.

As shown in FIG. 19, the protruded part 326 protrudes toward the normal line of the slope surface part 322. The protruded part 326 is formed to be elongated in the curved direction of the slope surface part 322. In other words, the protruded part 326 is formed to approach the front end side in the plug axial direction Z of the spark plug 1 while being separated from the flat surface part 321 in the ground electrode width direction X.

The more the protruded part 326 approaches the central part in its longitudinal direction, the more the projecting amount of the protruded part 326 increases. Edge parts 326*a* are formed at the end parts of the protruded part 326. The edge parts 326*a* formed at both sides in the extending direction Y of the protruded part 326 are formed substantially parallel to the curved direction of the slope surface part 322. That is, the edge parts 326*a* formed at both the end parts of the protruded part 326 are curved toward the front end side in the plug axial direction Z of the spark plug 1 while being separated in the ground electrode width direction X from the flat surface part 321.

As shown in FIG. 20, the protruded part 326 is formed at the area adjacent to the projected circle 221*a* of the front end surface 221 when viewed in the ground electrode width direction X. The protruded part 326 is also formed in the area opposite to the curved part 33 side when viewed from the central part of the slope surface part 322 in the extending direction Y.

It is possible to produce each of the slope surface part 322 and the protruded part 326 by cutting a protruding member which is also used for forming the ground electrode 3. It is possible to cut the protruding member to produce the protruded part 326 so that the protruded part 326 has a gentle curved surface when compared with the surface of the slope surface part 322. That is, the protruded part 326 is formed by cutting less than when forming the slope surface part 322.

Other components of the spark plug 1 according to the fourth exemplary embodiment are the same of those of the spark plug 1 according to the first exemplary embodiment.

Because the structure of the spark plug 1 according to the fourth exemplary embodiment allows electric fields to be concentrated around the edge parts 326*a* of the protruded part 326, this makes it possible to easily and stably move the start point S1 of the spark discharge S. This structure makes it possible to easily separate the start point S1 of the spark discharge S at the ground electrode 3 side from the start point of the spark discharge at the central electrode 2 side. Further, this structure makes it possible to improve the ignition capability of the spark plug 1 to ignite the fuel mixture gas.

Further, the spark plug 1 according to the fourth exemplary embodiment has the same behavior and effects of the spark plug 1 according to the first exemplary embodiment.

Fifth Exemplary Embodiment

A description will be given of the spark plug according to a fifth exemplary embodiment of the present disclosure with reference to FIG. 21 and FIG. 22.

The spark plug 1 according to the fifth exemplary embodiment is different in shape of the slope surface part from the spark plug 1 according to the first exemplary embodiment.

Figure 21:
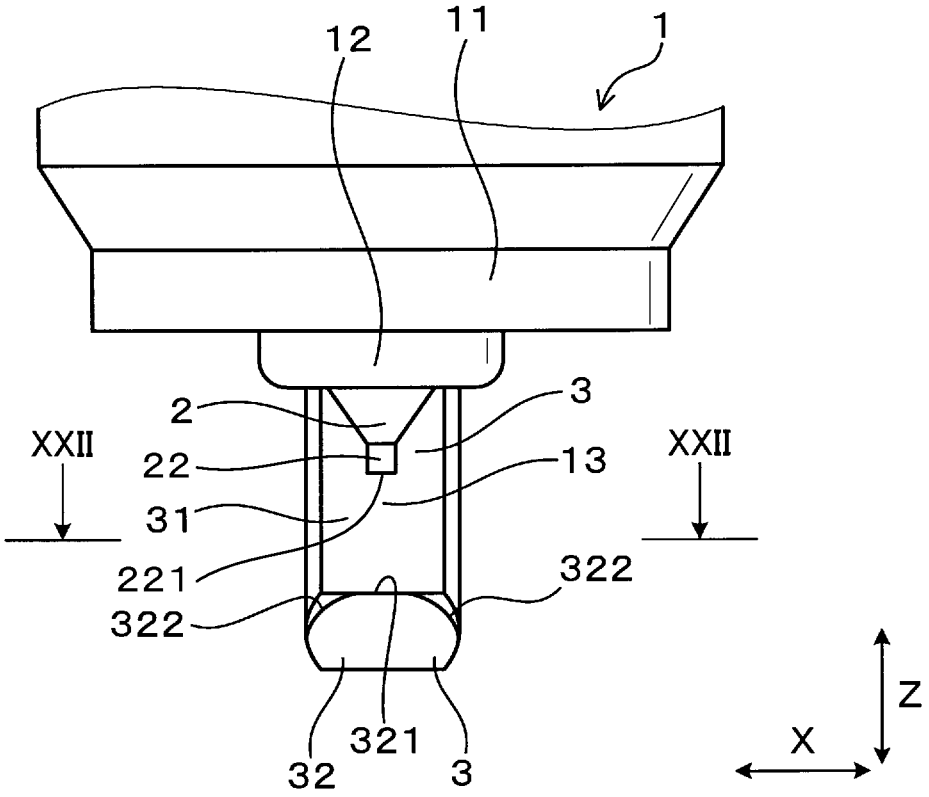
FIG. 21 is a plan view showing a front end part of the spark plug according to a fifth exemplary embodiment of the present disclosure.

FIG. 21 is a plan view showing a front end part of the spark plug 1 according to the fifth exemplary embodiment of the present disclosure. FIG. 22 is a view showing a cross section of the spark plug 1 along the line XXII-XXII shown in FIG. 21.

Figure 22:
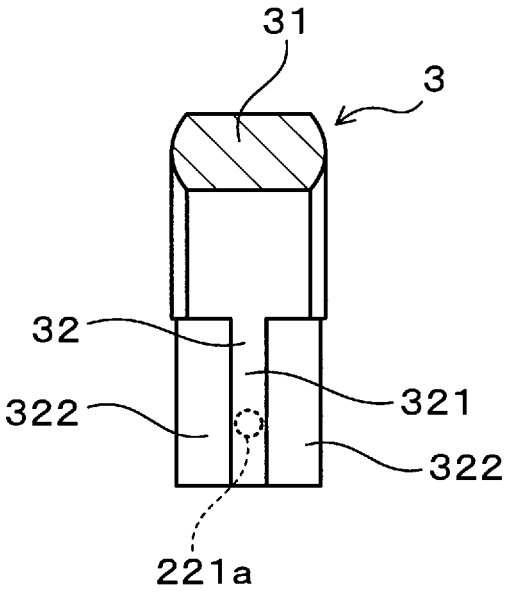
FIG. 22 is a view showing a cross section of the spark plug along the line XXII-XXII shown in FIG. 21.

As shown in FIG. 21 and FIG. 22, a pair of the slope surface parts 322 are formed at both sides of the flat surface part 321 when viewed along the ground electrode width direction X. Both the slope surface parts 322 are formed linearly symmetrical with the ground electrode width direction X. The flat surface part 321 is formed between the pair of the slope surface parts 322 on the distal end part of the opposing part 32. As can be understood from FIG. 21 and FIG. 22, the flat surface part 321 is formed on the opposing part 32 to face the central electrode 2 and to be overlapped with the front end part 221 of the central electrode tip 22 when viewed in the plug axial direction Z of the spark plug 1.

Other components of the spark plug 1 according to the fifth exemplary embodiment are the same of those of the spark plug 1 according to the first exemplary embodiment.

Because the spark plug 1 according to the fifth exemplary embodiment has the structure in which both the slope surface parts 322 are formed linearly symmetrical with the ground electrode width direction X, this structure makes it possible to allow the ground electrode 3 to be easily produced. Further, it is possible to improve the ignition capability of the spark plug 1 by arranging one of the slope surface parts 322 at the downstream side of the flow F of a fuel mixture gas. This improved structure of the ground electrode 3 makes it possible to allow the spark plug 1 to be easily assembled with the engine head of the internal combustion engine.

Further, the spark plug 1 according to the fifth exemplary embodiment has the same behavior and effects of the spark plug 1 according to the first exemplary embodiment.

Incidentally, a related art discloses a spark plug having a structure in which a ground electrode has a rod-shaped part and an opposing part. The rod-shaped part of the ground electrode extends from a front end part of a spark plug housing in an axial direction of the spark plug. The opposing part of the ground electrode is formed extending from the rod-shaped part and being inwardly curved in a radius direction of the spark plug. The opposing part of the ground electrode faces the central electrode in the axial direction of the spark plug.

The opposing part of the ground electrode is composed of a flat surface part and a slope surface part. The flat surface part is formed on the ground electrode along a direction which is perpendicular to the axial direction of the spark plug. The slope surface part is formed at a part of the ground electrode extending from the opposing part and being separated from the central electrode along the axial direction of the spark plug.

When the slope surface part of the ground electrode is arranged at a downstream side of a fuel mixture gas which is flowing in the discharge gap formed between the central electrode and the ground electrode, this makes it possible for the spark plug to increase its ignition capability to ignite the fuel mixture gas in the combustion chamber of the internal combustion engine.

That is, the fuel mixture gas in the discharge gap formed between the central electrode and the ground electrode flows smoothly along the flat surface part and the slope surface part of the ground electrode. When the fuel mixture gas flows from the discharge gap toward the downstream of the flow of the fuel mixture gas, the fuel mixture gas is gradually curved along the front end side, and flows at the downstream side toward the front end part along the axial direction of the spark plug. Accordingly, the discharge spark generated at the discharge gap becomes easily extended toward the front end side around the bottom side of the discharge gap, and the generated discharge spark extended by the flow of the fuel gas mixture becomes separated from the engine head of the internal combustion engine. As a result, thermal energy of a flame is generated by the discharge spark when the discharge spark ignites the fuel mixture gas, and this suppresses the thermal energy of the flame from being absorbed by the engine head, and increases the flame from the discharge spark. Further, because the fuel mixture gas flowing in the discharge gap is smoothly flowing along the flat surface part and the slope surface part of the ground electrode, this prevents a disturbance of the flow of the fuel mixture gas and maintains, maintains the ignition capability of the spark plug to ignite the fuel mixture gas. However, there is room for improvement on a structure of the spark plug so as to improve the ignition capability of the spark plug to ignite a fuel mixture gas.

On the other hand, the present disclosure provides the spark plug having the improved structure previously described in detail. In the structure of the spark plug having the ground electrode composed of the flat surface part and the slope surface part, the spark plug has the ratio V/W within the range of $0.5<V/W<2.0$. This structure makes it possible to improve the ignition capability of the spark plug to ignite a fuel mixture gas. The specific range of the ratio V/W is supported on the basis of experimental results which will be explained later in detail. The present disclosure provides the spark plug having the improved structure and superior ignition capability. It is possible to apply the spark plug according to various exemplary embodiments of the present disclosure to various types of internal combustion engines.

While specific embodiments of the present disclosure have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present disclosure which is to be given the full breadth of the following claims and all equivalents thereof.

What is claimed is:

1. A spark plug comprising:

a spark plug housing having a cylindrical shape;

an insulator having a cylindrical shape and being arranged in and supported by an inside of the spark plug housing;

a central electrode supported in an inside of the insulator, and a front end part of the central electrode projecting;

a ground electrode being arranged to form a discharge gap between the central electrode and the ground electrode, the ground electrode comprising a rod-shaped part and an opposing part, the rod-shaped part extending from a front end part of the spark plug housing toward a front end part of the spark plug, the opposing part having a curved shape which being curved from the rod-shaped part inwardly in a radius direction of the spark plug, and the opposing part facing the central electrode, the opposing part comprising a flat surface part and a slope surface part, the flat surface part having a flat-shaped surface which faces the central electrode side, the slope surface part being formed on a part of the opposing part along an extending direction of the opposing part, the opposing part being gradually separated from the central electrode along a width direction of the opposing part, wherein the spark plug has a ratio V/W within a range of 0.5<V/W<2.0, where V indicates a length of the opposing part measured in a gap formation direction in which the central electrode, the discharge gap and the opposing part are arranged in order, and W indicates a width length of the opposing part in the width direction of the opposing part, the slope surface part has a first end part and a second end part, the first end part of the slope surface part is connected to an end part of the flat surface part in the width direction of the opposing part, and the second end part of the slope surface part is connected to an end part of a back surface of the opposing part, and the back surface of the opposing part is opposite to a front surface of the opposing part, and the opposing part faces the central electrode side in the gap formation direction.

2. The spark plug according to claim 1, wherein the spark plug has the ratio V/W within a range of V/W<=1.7.

3. The spark plug according to claim 1, wherein the spark plug has the ratio V/W within a range of V/W>=1.0.

4. The spark plug according to claim 3, wherein the slope surface part comprises one of a protruded part and a recessed part, wherein the protruded part is continuously formed in the slope surface part from the end part of the flat surface part to the end part of the back surface of the ground electrode, and the recessed part is continuously formed in the slope surface part from the end part of the flat surface part to the end part of the back surface of the ground electrode.

5. The spark plug according to claim 1, wherein the flat surface part is formed on the opposing part to face the central electrode in the gap formation direction and is overlapped with a front end part of the central electrode when viewed in a plug axial direction of the spark plug.

6. A spark plug comprising:

a spark plug housing having a cylindrical shape;

an insulator having a cylindrical shape and being arranged in and supported by an inside of the spark plug housing;

a central electrode supported in an inside of the insulator, and a front end part of the central electrode projecting;

a ground electrode being arranged to form a discharge gap between the central electrode and the ground electrode, the ground electrode comprising a rod-shaped part and an opposing part, the rod-shaped part extending from a front end part of the spark plug housing toward a front end part of the spark plug, the opposing part having a curved shape which being curved from the rod-shaped part inwardly in a radius direction of the spark plug, and the opposing part facing the central electrode, the opposing part comprising a flat surface part and a slope surface part, the flat surface part having a flat-shaped surface which faces the central electrode side, the slope surface part being formed on a part of the opposing part along an extending direction of the opposing part, the opposing part being gradually separated from the central electrode along a width direction of the opposing part, wherein the spark plug has a ratio V/W within a range of 0.5<V/W<2.0, where V indicates a length of the opposing part measured in a gap formation direction in which the central electrode, the discharge gap and the opposing part are arranged in order, and W indicates a width length of the opposing part in the width direction of the opposing part, the slope surface part comprises one of a protruded part and a recessed part, the protruded part is continuously formed in the slope surface part from the end part of the flat surface part to the end part of the back surface of the opposing part in the ground electrode, and the recessed part is continuously formed in the slope surface part from the end part of the flat surface part to the end part of the back surface of the opposing part in the ground electrode.

7. A spark plug according to claim 6, wherein:

the spark plug has the ratio V/W within a range of V/W<=1.7.

8. A spark plug according to claim 6, wherein:

the spark plug has the ratio V/W within a range of V/W>=1.0.

9. A spark plug according to claim 6, wherein:

the flat surface part is formed on the opposing part to face the central electrode in the gap formation direction and is overlapped with a front end part of the central electrode when viewed in a plug axial direction of the spark plug.

* * * * *